US009657741B2

(12) United States Patent
Chung et al.

(10) Patent No.: US 9,657,741 B2
(45) Date of Patent: May 23, 2017

(54) MAGNET CASE AND ROTOR INCORPORATING THE SAME

(71) Applicant: Foxconn Technology Co., Ltd., New Taipei (TW)

(72) Inventors: Ming-Hsiu Chung, New Taipei (TW); Yu-Ching Lin, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 732 days.

(21) Appl. No.: 14/101,348

(22) Filed: Dec. 10, 2013

(65) Prior Publication Data

US 2014/0169966 A1 Jun. 19, 2014

(30) Foreign Application Priority Data

Dec. 13, 2012 (TW) ..... 101147260 A

(51) Int. Cl.

| | |
|---|---|
| ***F04D 25/06*** | (2006.01) |
| ***F04D 29/26*** | (2006.01) |
| ***F04D 29/32*** | (2006.01) |
| ***F04D 29/66*** | (2006.01) |

(52) U.S. Cl.

CPC ..... *F04D 25/064* (2013.01); *F04D 29/263* (2013.01); *F04D 29/329* (2013.01); *F04D 29/666* (2013.01)

(58) Field of Classification Search

CPC .... F04D 25/064; F04D 29/329; F04D 29/263; F04D 29/666; F04D 25/06; F04D 29/66; H02K 1/2733

See application file for complete search history.

(56) References Cited

U.S. PATENT DOCUMENTS

| | | | | |
|---|---|---|---|---|
| 5,345,129 A * | 9/1994 | Molnar | ..... | H02K 11/40 310/156.28 |
| 5,962,938 A * | 10/1999 | Bobay | ..... | H02K 1/187 310/156.26 |
| 6,348,752 B1 * | 2/2002 | Erdman | ..... | H02K 11/40 310/194 |
| 7,626,295 B2 * | 12/2009 | Yamaguchi | ..... | F04D 29/281 310/156.32 |

(Continued)

FOREIGN PATENT DOCUMENTS

| | | |
|---|---|---|
| CN | 201092981 Y | 7/2008 |
| JP | 2004092446 A | 3/2004 |
| TW | 426272 | 3/2001 |

OTHER PUBLICATIONS

Huang, CN201092981 Translation, 2007, Espace Machine Translation.*

*Primary Examiner* — Craig Kim
*Assistant Examiner* — Eldon Brockman
(74) *Attorney, Agent, or Firm* — Steven Reiss

(57) ABSTRACT

A magnet case for a rotor includes a hollow cylindrical supporting body for accommodating two magnetic bands, an annular flange extending outwardly from a top end of the supporting body, and a positioning plate extending inwardly from a bottom end of the supporting body. The annular flange of the magnet case has two spaced notches defined in an outer periphery thereof, and the two spaced notches are configured to reduce vibration of a cooling fan associated with the rotor during operation of the cooling fan. A rotor incorporating the magnet case is also provided.

18 Claims, 2 Drawing Sheets

(56) References Cited

U.S. PATENT DOCUMENTS

| | | | | |
|---|---|---|---|---|
| 8,137,079 | B2 * | 3/2012 | Yamazaki | F04D 25/0613<br>417/354 |
| 8,651,807 | B2 * | 2/2014 | Inada | F04D 25/0613<br>415/208.2 |
| 2004/0104631 | A1 * | 6/2004 | Noguchi | H02K 5/1675<br>310/81 |
| 2005/0111985 | A1 * | 5/2005 | Chen | F04D 29/263<br>416/204 R |
| 2007/0098571 | A1 * | 5/2007 | Nagamatsu | F04D 25/0613<br>417/354 |
| 2007/0104593 | A1 * | 5/2007 | Yamaguchi | F04D 29/281<br>417/354 |
| 2008/0232983 | A1 * | 9/2008 | Yamazaki | F04D 25/0613<br>417/354 |
| 2011/0255957 | A1 * | 10/2011 | Inada | F04D 25/0613<br>415/119 |
| 2012/0251321 | A1 * | 10/2012 | Fuchibe | F04D 25/0613<br>416/185 |

* cited by examiner

MAGNET CASE AND ROTOR INCORPORATING THE SAME

TECHNICAL FIELD

The present disclosure relates generally to a rotor applied in a cooling fan, such as a cooling fan used inside electronic equipment.

DESCRIPTION OF RELATED ART

Nowadays, cooling fans are widely applied for dissipating heat generated by electronic devices during their operation. A cooling fan generally includes an impeller, which has a hub and a plurality of blades connected with the hub. The impeller is driven by a motor. The motor includes a stator, and a rotor mounted on the stator. The rotor includes a magnet case, a magnetic band disposed on an inner side of the magnet case, and a shaft extending downwardly from the center of the magnet case towards the stator. The magnet case is generally fixed to the hub of the impeller by gluing, welding or bolting.

However, the impeller of the cooling fan is generally integrally formed as one monolithic piece by injection molding. This can result in an uneven weight distribution of the finished blades, due to variations in pressure or temperature during the manufacturing process. Thus the center of gravity of the impeller is liable to deviate from the axis of the shaft, and this may cause the cooling fan incorporating the impeller to vibrate during operation.

What is needed, therefore, is a means which can overcome the above-mentioned limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
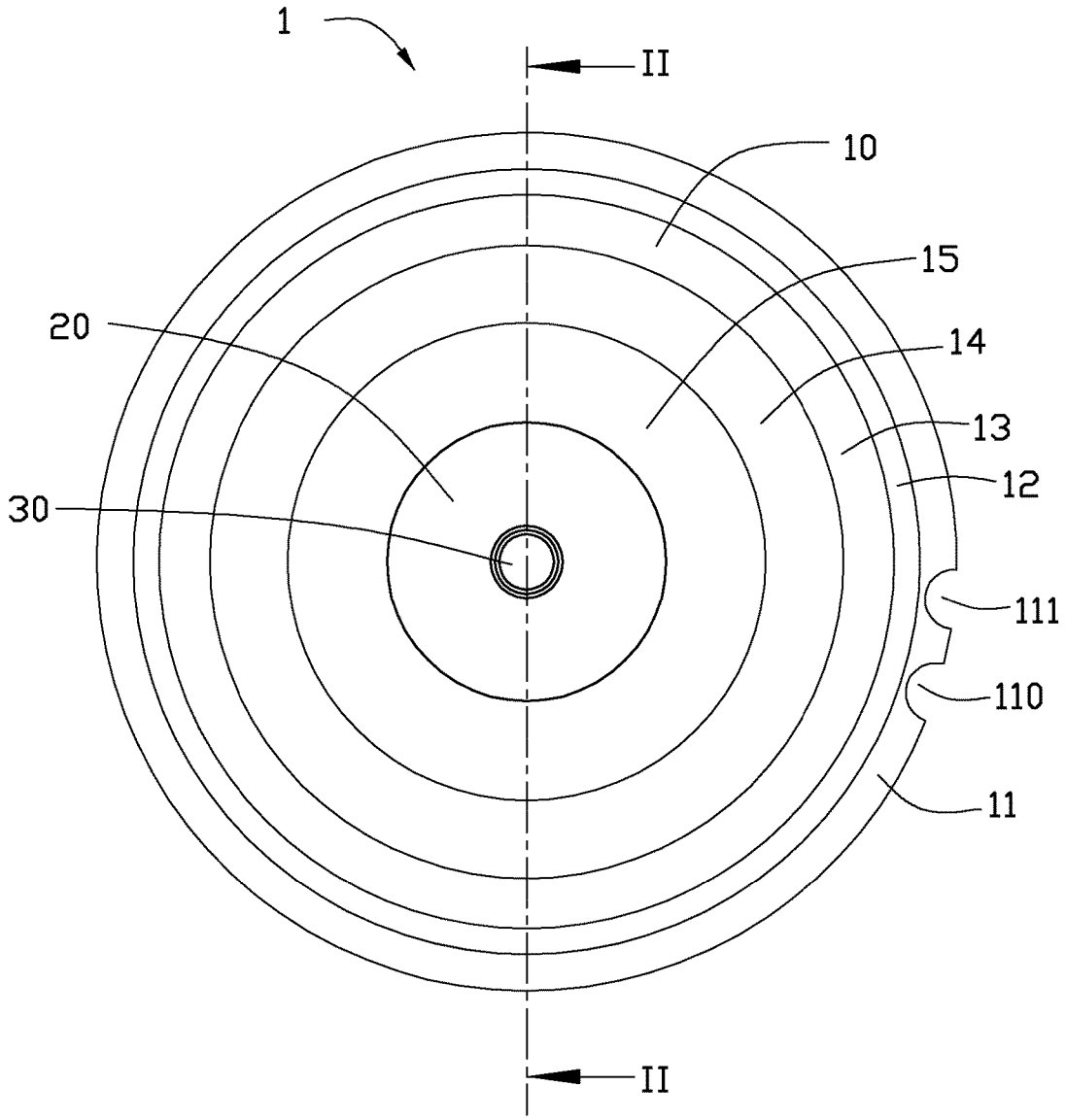
FIG. 1 is a schematic, bottom plan view of a rotor in accordance with an exemplary embodiment of the present disclosure.
Figure 2:
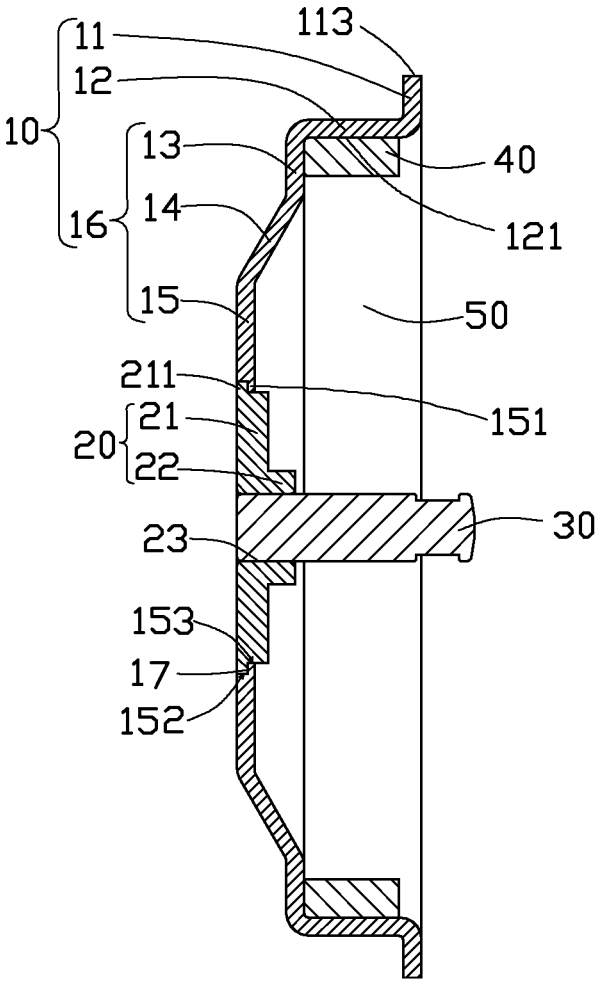
FIG. 2 is a schematic, cross-sectional view of the rotor of FIG. 1, taken along line II-II thereof, and showing two magnetic bands disposed on an inner side of a magnet case.

Referring to FIGS. 1 and 2, a rotor 1 in accordance with an exemplary embodiment of the present disclosure is illustrated. The rotor 1 includes a magnet case 10, two magnetic bands 40 disposed on an inner side of the magnet case 10, a bushing 20 positioned at the bottom of the magnet case 10, and a shaft 30 engaged in the bushing 20.

The magnet case 10 includes a hollow cylindrical supporting body 12, an annular flange 11 extending outwardly from a top end of the supporting body 12, and a positioning plate 16 extending inwardly from a bottom end of the supporting body 12. The magnet case 10 defines a cavity 50 therein. The magnet case 10 is made of metal, such as iron or copper alloy.

The positioning plate 16 includes a first annular section 13, a third annular section 15, and a second annular section 14 interconnecting the first and third annular sections 13, 15.

The first annular section 13 extends inwardly a short distance from the bottom end of the supporting body 12 along radial directions of the supporting body 12. The second annular section 14 extends inwardly and slantwise from an inner periphery of the first section 13. The third annular section 15 extends inwardly from an inner periphery of the second annular section 14 along radial directions of the supporting body 12. The third annular section 15 is located below the first annular section 13. Alternatively, the positioning plate 16 can consist of the first annular section 13 only.

The annular flange 11 of the magnet case 10 is provided with two notches, i.e., a first notch 110 and a second notch 111, in an outer periphery 113 thereof. The first and second notches 110, 111 are separate from each other. In the present embodiment, the first and second notches 110, 111 are adjacent to each other. Both the first and second notches 110, 111 are approximately segment-shaped. In particular, a surface of the annular flange 11 bounding an inner side of each of the first and second notches 110, 111 is arc-shaped. The first and second notches 110, 111 have a same radius. A radius of the supporting body 12 is ten times larger than that of each of the first and second notches 110, 111.

A mounting hole 152 is defined in the center of the third annular section 15 of the positioning plate 16. A holding ring portion 151 protrudes radially inwardly into the mounting hole 152 from a top edge of the inner periphery of the third annular section 15. The holding ring portion 151 defines a through hole 153 communicating with the mounting hole 152. An annular step 17 is formed where the holding ring portion 151 and the inner periphery of the third annular section 15 meet.

The bushing 20 includes a disk-shaped (or cylindrical) base 21, a guide pole 22 extending upwardly from a central region of the top of the base 21, and a clamping ring portion 211 protruding radially outwardly from a bottom peripheral edge of the base 21. A diameter of the base 21 of the bushing 20 is substantially same as that of the through hole 153 of the holding ring portion 151, but smaller than that of the mounting hole 152. The bushing 20 defines a guide hole 23 extending therethrough from the top to the bottom (i.e., a right-to-left direction as viewed in FIG. 2).

The bushing 20 is located in the mounting hole 152 of the third annular section 15 of the positioning plate 16, with the base 21 of the bushing 20 extending through the through hole 153, and a top end of the base 21 and the guide pole 22 of the bushing 20 being received in the cavity 50. The clamping ring portion 211 of the bushing 20 is engaged with the holding ring portion 151 of the third annular section 15 of the positioning plate 16, so as to firmly fix the bushing 20 onto the magnet case 10.

One end of the shaft 30 is engaged in the guide hole 23 of the bushing 20, while the other end of the shaft 30 is rotatably connected to a stator (not shown). The shaft 30 extends into the cavity 50 and is surrounded by the magnet case 10. The shaft 30 is positioned on the axis of the supporting body 12 of the magnet case 10.

The two magnetic bands 40 are disposed on an inner side 121 of the supporting body 12 of the magnet case 10. The two magnetic bands 40 are separate from each other. The two magnetic bands 40 are symmetric with respect to the shaft 30. Each magnetic band 30 is arc-shaped, and extends parallel to an axial direction of the supporting body 12 from the top end of the supporting body 12 to the bottom end of the supporting body 12. Alternatively, the number of magnetic bands 40 can be changed according to actual requirements.

In the present disclosure, the annular flange 11 of the magnet case 10 is provided with the first and second notches 110, 111 in the outer periphery 113 thereof. The rotor 1 having the magnet case 10 can be used with an impeller of a cooling fan. The impeller may be slightly defective in that a center of gravity of the impeller does not coincide with a geometrical central axis of the impeller. Nevertheless, the magnet case 10 with the first and second notches 110, 111 is able to compensate for any unbalancing that would otherwise exist due to the off-center center of gravity of the impeller. This can effectively eliminate or at least reduce vibration of the cooling fan during rotation of the impeller. Furthermore, the first and second notches 110, 111 are far away from the shaft 30. Accordingly, the effect of the magnet case 10 on the turning moment of the rotor 1 is significant, due to the relatively large radius of the rotor 1 at the first and second notches 110, 111.

It is to be understood that the number and the shape of the first and second notches 110, 111 formed in the outer periphery 113 of the annular flange 11 of the magnet case 10 can be changed according to the particular location of the center of gravity of the impeller used with the rotor 1. It is preferred that the first and second notches 110, 111 are formed by a drilling, punching or etching process.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments.

What is claimed is:

1. A magnet case for a rotor, the magnet case comprising:
- a hollow cylindrical supporting body for accommodating at least one magnetic band;
- an annular flange extending outwardly from a top end of the supporting body; and
- a positioning plate extending inwardly from a bottom end of the supporting body;
- wherein the annular flange of the magnet case has at least one notch defined in and sunken from an outer periphery thereof, and the at least one notch is configured to reduce vibration of a cooling fan associated with the rotor during the operation of the cooling fan;
- wherein a direction of extension of the annular flange is substantially perpendicular to a central axis of the hollow cylindrical supporting body, and a sinking direction of the at least one sunken notch is also substantially perpendicular to the central axis of the magnet case.

2. The magnet case of claim 1, wherein the at least one notch comprises two notches, which are separate from each other.

3. The magnet case of claim 2, wherein the two notches are substantially segment-shaped.

4. The magnet case of claim 3, wherein the two notches have a same radius.

5. The magnet case of claim 4, wherein a radius of the supporting body is ten times larger than a radius of each of the two notches.

6. The magnet case of claim 1, wherein the positioning plate comprises a first annular section, a third annular section, and a second annular section interconnecting the first and third annular sections, the first annular section extends inwardly from the bottom end of the supporting body along radial directions of the supporting body, the second annular section extends inwardly and slantwise from an inner periphery of the first section, the third annular section extends inwardly from an inner periphery of the second annular section along radial directions of the supporting body, and the third annular section is located below the first annular section.

7. The magnet case of claim 6, wherein a mounting hole is defined in the center of the third annular section, for mounting a bushing therein.

8. The magnet case of claim 1, wherein the magnet case is made of metal.

9. A rotor for a cooling fan, the rotor comprising:
- a magnet case comprising:
  - a hollow cylindrical supporting body;
  - an annular flange extending outwardly from a top end of the supporting body; and
  - a positioning plate extending inwardly from a bottom end of the supporting body; and
  - two magnetic bands disposed on an inner side of the supporting body;
- wherein the annular flange of the magnet case has at least one notch defined in and sunken from an outer periphery thereof, and the at least one notch is structured and arranged to reduce vibration of a cooling fan associated with the rotor during operation of the cooling fan;
- wherein a direction of extension of the annular flange is substantially perpendicular to a central axis of the hollow cylindrical supporting body, and a sinking direction of the at least one sunken notch is also substantially perpendicular to the central axis of the magnet case.

10. The rotor of claim 9, wherein the two notches are approximately segment-shaped.

11. The rotor of claim 10, wherein a radius of the supporting body is ten times larger than a radius of each of the two notches.

12. The rotor of claim 9, wherein a mounting hole is defined in the center of the positioning plate, for mounting a bushing therein.

13. The rotor of claim 12, further comprising a bushing located in the mounting hole of the positioning plate, and a shaft engaged with the bushing, wherein the shaft is surrounded by the magnet case.

14. The rotor of claim 13, wherein the bushing comprises a disk-shaped base and a guide pole extending upwardly from a central region of the top of the base, and the bushing defines a guide hole extending therethrough from the top to the bottom, one end of the shaft being engaged in the guide hole.

15. The rotor of claim 14, wherein a clamping ring portion protrudes radially outwardly from a bottom edge periphery of the base, and a holding ring portion protrudes radially inwardly into the mounting hole from a top edge of the inner periphery of the positioning plate, the clamping ring portion engaging with the holding ring portion.

16. The rotor of claim 15, wherein the holding ring portion defines a through hole communicating with the mounting hole, a diameter of the base of the bushing is substantially same as that of the through hole but smaller than that of the mounting hole, the base of the bushing extends through the through hole, and a top end of the base and the guide pole of the bushing is received in a space surround by the supporting body of the magnet case.

17. The rotor of claim 14, wherein the shaft is positioned on axis of the supporting body, and the two magnetic bands are symmetric with respect to the shaft, each magnetic band extending parallel to an axial direction of the supporting body from the top end of the supporting body to the bottom end of the supporting body.

18. The rotor of claim 12, wherein the positioning plate comprises a first annular section, a third annular section, and a second annular section interconnecting the first and third annular sections, the first annular section extends inwardly from the bottom end of the supporting body along radial directions of the supporting body, the second annular section extends inwardly and slantwise from an inner periphery of the first section, the third annular section extends inwardly from an inner periphery of the second annular section along radial directions of the supporting body, the third annular section is located below the first annular section, and the mounting hole is defined in the center of the third annular section.

* * * * *